US009404457B2

(12) United States Patent
Hironobu et al.

(10) Patent No.: US 9,404,457 B2
(45) Date of Patent: Aug. 2, 2016

(54) FUEL SUPPLY SYSTEM FOR INTERNAL COMBUSTION ENGINE

(71) Applicant: HONDA MOTOR CO., LTD., Tokyo (JP)

(72) Inventors: Hidekazu Hironobu, Wako (JP); Masaaki Nagashima, Wako (JP); Yosuke Kosaka, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 879 days.

(21) Appl. No.: 13/736,604

(22) Filed: Jan. 8, 2013

(65) Prior Publication Data

US 2013/0174809 A1 Jul. 11, 2013

(30) Foreign Application Priority Data

Jan. 10, 2012 (JP) ..... 2012-002025

(51) Int. Cl.
*F02M 59/36* (2006.01)
*F02M 59/10* (2006.01)

(52) U.S. Cl.
CPC ..... *F02M 59/366* (2013.01); *F02M 59/102* (2013.01); *F02M 59/368* (2013.01); *F02D 2250/12* (2013.01)

(58) Field of Classification Search
CPC . F02M 59/102; F02M 59/366; F02M 59/368; F02D 2250/12; F02D 2250/31
USPC ..... 123/446, 452, 456, 458; 701/101–105
See application file for complete search history.

(56) References Cited

U.S. PATENT DOCUMENTS 6,799,556 B1 * 10/2004 Makino ..... F02P 5/1504 123/406.24
8,315,780 B2 * 11/2012 Toyohara ..... F02M 59/367 123/456

(Continued)

FOREIGN PATENT DOCUMENTS

DE 10 2007 027 709 A1 7/2008
EP 1 452 711 A2 9/2004

(Continued)

OTHER PUBLICATIONS

European Search Report, JP Application No. 13150495.3 dated Jul. 12, 2013.

(Continued)

*Primary Examiner* — Hieu T Vo
*Assistant Examiner* — Arnold Castro
(74) *Attorney, Agent, or Firm* — Mori & Ward, LLP

(57) ABSTRACT

A fuel supply system for an internal combustion engine capable of executing calculation of an energization time of the electromagnetic valve at proper timing and thereby properly controlling the amount of fuel to be discharged from the fuel pump toward a fuel injection valve. In the fuel supply system, when a predetermined timing corresponding to a predetermined crank angle position of the engine deviates from a predetermined cam angle timing which is within a predetermined time period including a timing at which a top of a cam nose of the driving cam is abutting a plunger, and preceding and following the timing, and corresponds to a predetermined rotational angle position of the driving cam, the calculation timing of the energization time is corrected such that the calculation timing is made closer to the cam angle timing.

9 Claims, 9 Drawing Sheets

(56) References Cited

U.S. PATENT DOCUMENTS

| | | | | |
|---|---|---|---|---|
| 2005/0229896 | A1 | 10/2005 | Hori | |
| 2007/0034191 | A1 | 2/2007 | Oono | |
| 2008/0025849 | A1* | 1/2008 | Okamoto | F02D 41/3845 417/213 |
| 2009/0299606 | A1* | 12/2009 | Dintino | F02D 41/2464 701/103 |
| 2011/0184633 | A1 | 7/2011 | Mueller et al. | |

FOREIGN PATENT DOCUMENTS

| | | | |
|---|---|---|---|
| EP | 2 128 416 | A1 | 12/2009 |
| JP | 2005-307747 | A | 11/2005 |

OTHER PUBLICATIONS

Chinese Office Action for corresponding CN Application No. 201210577132.1, Aug. 1, 2014.

* cited by examiner

FUEL SUPPLY SYSTEM FOR INTERNAL COMBUSTION ENGINE

BACKGROUND OF THE INVENTION

1. Field of the Invention

The present invention relates to a fuel supply system including a fuel pump which uses an internal combustion engine as a motive power source.

2. Description of the Related Art

Conventionally, as a fuel supply system of this type of an internal combustion engine, one disclosed in Japanese Laid-Open Patent Publication No. 2005-307747, for example, is known. This conventional fuel supply system includes a fuel pump and an electromagnetic valve. The fuel pump includes a plunger abutting a driving cam which uses the engine as the motive power source, and the plunger is driven by the driving cam whereby fuel is discharged to a fuel injection valve side. The amount of the discharge of fuel is controlled by controlling an energization time period of the electromagnetic valve. Further, in the conventional fuel supply system, an attachment error between the driving cam and the fuel pump is estimated, and the energization time period is corrected based on the estimated attachment error so as to properly control the amount of fuel to be discharged via the electromagnetic valve. Further, calculation of the energization time period described above is executed at a timing (hereinafter referred to as "predetermined crank angle timing") which corresponds to a predetermined crank angle position of the engine.

In the fuel supply system including the fuel pump and the electromagnetic valve, described above, generally, a target value of the amount of fuel to be discharged from the fuel pump is calculated according to operating conditions of the engine, and the energization time (timing or time period) of the electromagnetic valve is calculated according to the calculated target value of the amount of fuel to be discharged and a parameter for control such as fuel pressure. In this case, with a view to properly controlling the amount of fuel to be discharged from the fuel pump, it is desirable that the calculation of the energization time is executed in such an appropriate timing (hereinafter referred to as "proper calculation timing") that the calculation is executed according to the newest control parameter and the energization of the electromagnetic valve is positively completed within the calculated energization time period. Further, since fuel is discharged by driving the plunger of the fuel pump using the driving cam, this proper calculation timing is generally corresponds to a predetermined rotational angle position of the driving cam, within a predetermined time period preceding and following a timing at which a top of a cam nose of the driving cam is abutting the plunger, inclusive of the timing. On the other hand, the predetermined crank angle timing mentioned above sometimes misses the proper calculation timing, depending on specifications of design of the engine.

On the other hand, in the conventional fuel supply system described above, the calculation timing of the energization time period of the electromagnetic valve is merely set to the predetermined crank angle timing. Therefore, when the predetermined crank angle timing misses proper calculation timing as described above, the calculation of the energization time period cannot be executed at the proper calculation timing. As a consequence, the calculation of the energization time period according to a newer parameter for control cannot be performed, and the energization of the electromagnetic valve cannot be completed within the calculated energization time period, and in turn, there is a fear that the amount of fuel to be discharged from the fuel pump cannot be properly controlled.

SUMMARY OF THE INVENTION

The present invention has been made to provide a solution to the above-described problems, and an object thereof is to provide a fuel supply system for an internal combustion engine capable of executing calculation of an energization time of the electromagnetic valve at proper timing and thereby properly controlling the amount of fuel to be discharged from the fuel pump toward a fuel injection valve.

To attain the object, according to a first aspect of the present invention, there is provided a fuel supply system for an internal combustion engine, comprising a fuel pump including a plunger abutting a driving cam which uses the engine as a motive power source, the fuel pump discharging fuel toward a fuel injection valve by having the plunger driven by the driving cam, an electromagnetic valve for adjusting an amount of fuel to be discharged from the fuel pump toward the fuel injection valve, energization time-calculating means for calculating an energization time of the electromagnetic valve for obtaining the amount of fuel to be discharged according to operating conditions of the internal combustion engine, the energization time-calculating means using a predetermined timing which corresponds to a predetermined crank angle position of the engine, as calculation timing of the energization time, and correction means for correcting, when the predetermined timing deviates from a predetermined cam angle timing which is within a predetermined time period including a timing at which a top of a cam nose of the driving cam is abutting the plunger, and preceding and following the timing, and corresponds to a predetermined rotational angle position of the driving cam, the calculation timing such that the calculation timing is made closer to the cam angle timing.

With this arrangement of the fuel supply system for an internal combustion engine, the plunger of the fuel pump is driven by the driving cam which uses the engine as the motive power source, whereby fuel is discharged from the fuel pump toward the fuel injection side, and the amount of fuel to be discharged is adjusted by the electromagnetic valve. Further, the energization time period of the electromagnetic valve for obtaining the amount of fuel to be discharged according to operating conditions of the engine is calculated by the energization time-calculating means, and a predetermined timing which corresponds to a predetermined crank angle position of the engine is used as a calculation timing of the energization time. Further, when the predetermined timing deviates from a predetermined cam angle timing which is within a predetermined time period including a timing at which a top of a cam nose of the driving cam is abutting the plunger, and preceding and following the timing, and corresponds to a predetermined rotational angle position of the driving cam, the calculation timing of the energization time is corrected by the corrections means such that the calculation timing is made closer to the cam angle timing.

This makes it possible to perform calculation of the energization time of the electromagnetic valve at such an appropriate timing as described above, and hence it is possible to perform calculation of the energization time period according to newer operating conditions of the engine, and complete the energization of the electromagnetic valve within the energization time period, and in turn, it is possible to properly control the amount of fuel to be discharged from the fuel pump toward the fuel injection valve.

Preferably, a plurality of crank angle positions including the predetermined crank angle position are set every predetermined crank angle, and the correction means corrects the calculation timing by selecting from a plurality of timings which correspond to the plurality of crank angle positions, respectively, one which is advanced from the cam angle timing and closest to the cam angle timing, as the calculation timing.

With this configuration, a plurality of crank angle positions including the predetermined crank angle position are set every predetermined crank angle, and the calculation timing is corrected by selecting from a plurality of timings which correspond to the plurality of crank angle positions, respectively, one which is advanced from the cam angle timing and closest to the cam angle timing, as the calculation timing. This makes it possible to perform calculation of the energization time of the electromagnetic valve, at the timing advanced from the cam angle timing and closest to the cam angle timing, and hence it is possible to positively obtain the advantageous effect that the energization of the electromagnetic valve can be completed within the energization time period.

Further, the plurality of crank angle positions set as described above are generally used for control of the fuel injection etc. of the engine, and hence it is possible to properly correct the calculation timing by making use of such a plurality of crank angle positions.

Preferably, the fuel supply system is provided in a vehicle, and the fuel supply system further comprises storage means storing an offset parameter which represents a deviation of the predetermined timing from the cam angle timing, which is determined before a shipping time of the vehicle, the correction means correcting the calculation timing based on the stored offset parameter.

Preferably, the driving cam is integrally provided on a camshaft interlocked with a crankshaft of the engine, and a cam phase variable mechanism is provided which changes a cam phase which is a phase of the camshaft with respect to the crankshaft, the fuel supply system further comprising offset parameter-detecting means for detecting an offset parameter which represents a deviation of the predetermined timing from the cam angle timing, and the correction means corrects the calculation timing based on the detected offset parameter.

According to these preferred embodiments, it is possible to more effectively provide the advantageous effects described above.

To attain the object, according to a second aspect of the present invention, there is provided a fuel supply system for an internal combustion engine, comprising a fuel pump including a plunger abutting a driving cam which uses the engine as a motive power source, the fuel pump discharging fuel toward a fuel injection valve by having the plunger driven by the driving cam, an electromagnetic valve for adjusting an amount of fuel to be discharged from the fuel pump toward the fuel injection valve, energization time-calculating means for calculating an energization time of the electromagnetic valve for obtaining the amount of fuel to be discharged according to operating conditions of the internal combustion engine, and calculation timing-setting means for setting, when a predetermined timing corresponding to a predetermined crank angle position of the engine deviates from a predetermined cam angle timing which is within a predetermined time period including a timing at which a top of a cam nose of the driving cam is abutting the plunger, and preceding and following the timing, and corresponds to a predetermined rotational angle position of the driving cam, out of a plurality of timings which correspond respectively to a plurality of crank angle positions set every predetermined crank angle such that the predetermined crank angle position is included, one closest to the cam angle timing, as a calculation timing of the energization time by the energization time-calculating means.

With this arrangement of the fuel supply system for an internal combustion engine, the plunger of the fuel pump is driven by the driving cam which uses the engine as the motive power source, whereby fuel is discharged from the fuel pump toward the fuel injection valve, and the amount of fuel to be discharged is adjusted by the electromagnetic valve. Further, the energization time period for obtaining the amount of fuel to be discharged according to the operating conditions of the engine is calculated by the energization time-calculating means. Further, the calculation timing of the energization time period of the electromagnetic valve is set by the calculation timing-setting means as follows: When a predetermined timing corresponding to a predetermined crank angle position of the engine deviates from a predetermined cam angle timing which is within a predetermined time period including a timing at which a top of a cam nose of the driving cam is abutting the plunger, and preceding and following the timing, and corresponds to a predetermined rotational angle position of the driving cam, out of a plurality of timings which correspond respectively to a plurality of crank angle positions set every predetermined crank angle such that the predetermined crank angle position is included, one closest to the cam angle timing is set as the calculation timing of the energization time.

This makes it possible to perform calculation of the energization time period of the electromagnetic valve at such an appropriate timing as described above, and hence it is possible to properly perform calculation of the energization according to newer operating conditions of the engine, and complete the energization of the electromagnetic valve within the energization time period, and in turn, it is possible to properly control the amount of fuel to be discharged from the fuel pump toward the fuel injection valve.

Further, the plurality of crank angle positions set as described above are generally used for control of the fuel injection etc. of the engine, and hence it is possible to properly set the calculation timing by making use of such a plurality of crank angle positions.

Preferably, the fuel supply system is provided in a vehicle, the fuel supply system further comprising storage means storing an offset parameter which represents a deviation of the predetermined timing from the cam angle timing, which is determined before a shipping time of the vehicle, and the calculation timing-setting means sets the calculation timing based on the stored offset parameter.

Preferably, the driving cam is integrally provided on a camshaft interlocked with a crankshaft of the engine, and a cam phase variable mechanism is provided which changes a cam phase which is a phase of the camshaft with respect to the crankshaft, the fuel supply system further comprising offset parameter-detecting means for detecting an offset parameter which represents a deviation of the predetermined timing from the cam angle timing, the calculation timing-setting means setting the calculation timing based on the detected offset parameter.

According to these preferred embodiments, it is possible to more efficiently provide the advantageous effects described above.

The above and other objects, features, and advantages of the present invention will become more apparent from the following detailed description taken in conjunction with the accompanying drawings.

DETAILED DESCRIPTION OF PREFERRED EMBODIMENT

Figure 1:
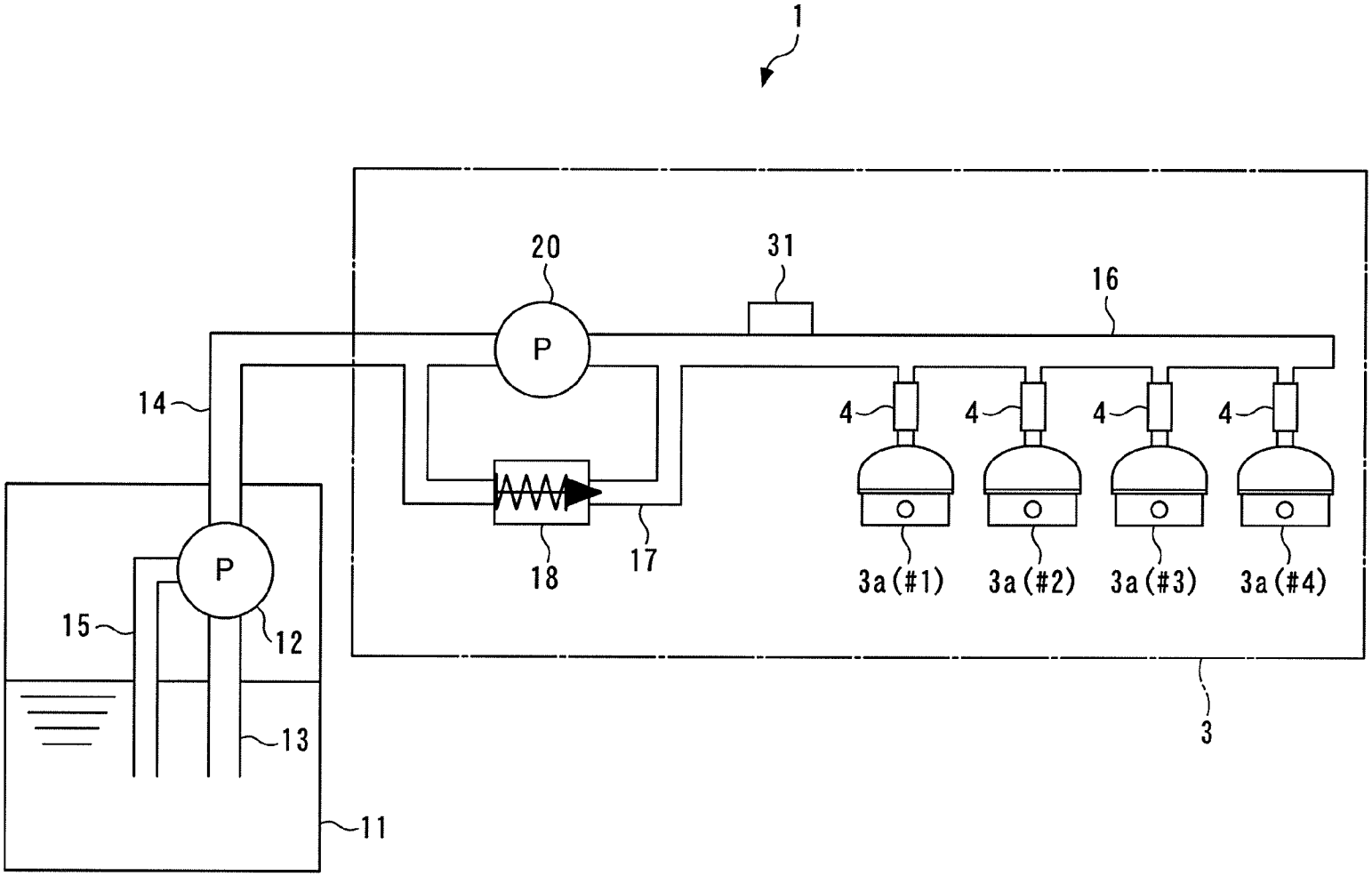
FIG. 1 is a schematic diagram of a fuel supply system according to an embodiment of the present invention and an internal combustion engine to which the fuel supply system is applied.

The invention will now be described in detail with reference to the drawings showing a preferred embodiment thereof. An internal combustion engine (hereinafter referred to as the "engine") 3 shown in FIG. 1 is a four-cycle gasoline engine for a vehicle (not shown), and includes four cylinders 3*a* (#1 to #4). Further, the engine 3 is provided with a fuel injection valve (hereinafter referred to as the "injector") 4 and a spark plug (not shown), for each cylinder 3*a*, and a fuel supply system 1 for supplying fuel to each injector 4.

Figure 2:
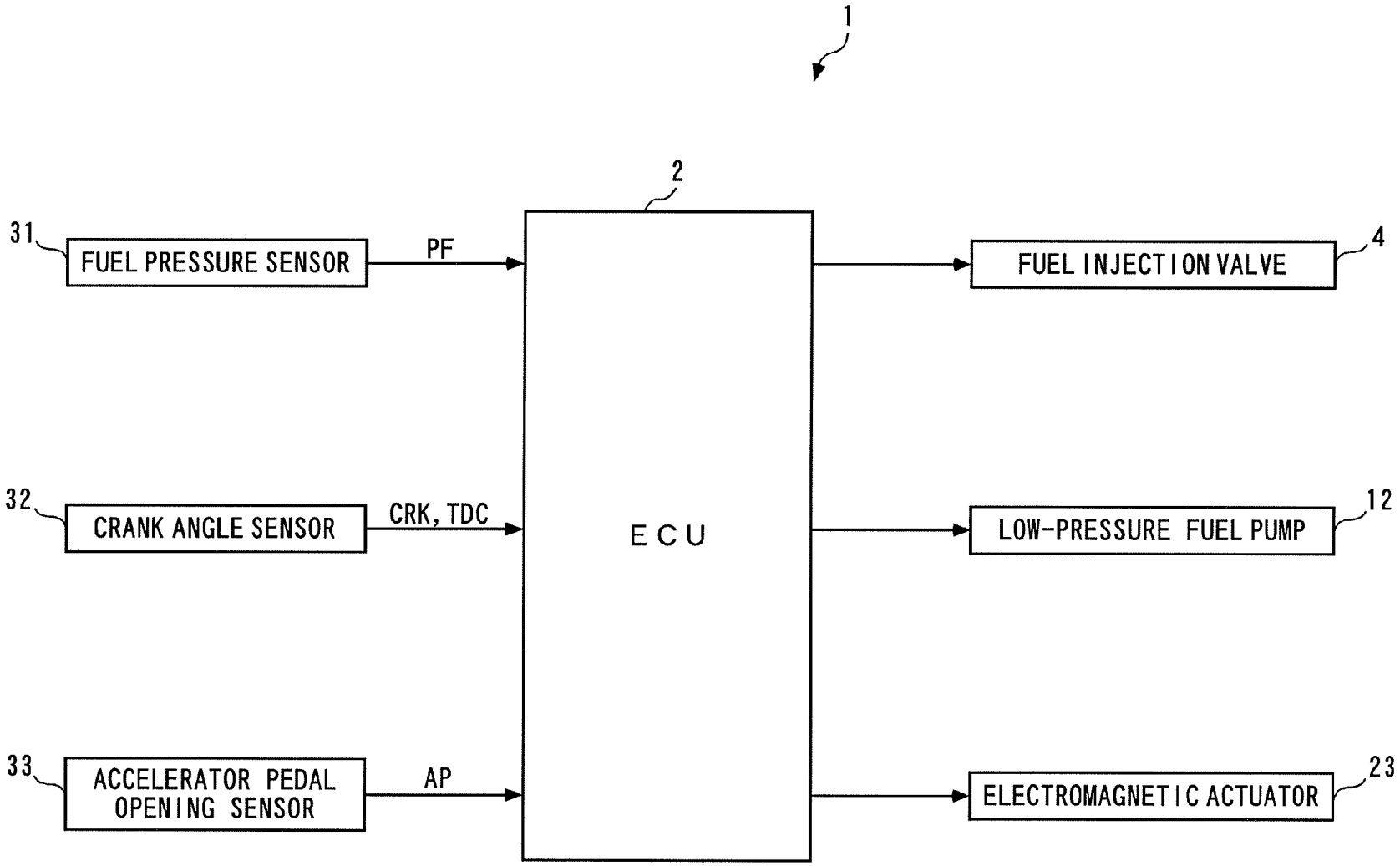
FIG. 2 is a block diagram of an ECU etc. of the fuel supply system.

Fuel for the engine 3 is injected directly from each injector 4 into a cylinder 3*a* associated therewith, and air-fuel mixture formed in the cylinder 3*a* is ignited by the spark plug. More specifically, the engine 3 is an in-cylinder injection engine. The opening and closing of the injector 4 is controlled by a control signal from an ECU 2 (see FIG. 2), referred to hereinafter, whereby fuel injection timing is controlled by valve opening timing, and the fuel injection amount is controlled by a valve open time period. In this case, the fuel injection timing is controlled to a predetermined timing within a time period from an intake stroke to a compression stroke. Note that, for convenience, only one injector 4 is illustrated in FIG. 2.

The above-mentioned fuel supply system 1 comprises a fuel tank 11 for storing fuel, a low-pressure fuel pump 12 which is provided in the fuel tank 11, and a high-pressure fuel pump 20.

The low-pressure fuel pump 12 is an electrically-driven type controlled by the ECU 2, and is always operated when the engine 3 is in operation. Further, a fuel suction passage 13, a low-pressure delivery pipe 14, and a fuel return passage 15 are connected to the low-pressure fuel pump 12. The low-pressure fuel pump 12 sucks fuel stored in the fuel tank 11 via the fuel suction passage 13, pressurizes the fuel to a predetermined low feed pressure (e.g. 392 kPa), and then discharges the same into the low-pressure delivery pipe 14, while returning excess fuel into the fuel tank 11 via the fuel return passage 15. Further, the above-mentioned high-pressure fuel pump 20 is connected to a downstream end of the low-pressure delivery pipe 14, and low-pressure fuel discharged from the low-pressure fuel pump 12 into the low-pressure delivery pipe 14 is supplied to the high-pressure fuel pump 20.

The high-pressure fuel pump 20 is a positive displacement pump linked to a crankshaft (not shown) of the engine 3, and is connected to a high-pressure delivery pipe 16. The high-pressure fuel pump 20 is driven by the crankshaft to thereby further pressurize the low-pressure fuel supplied from the low-pressure fuel pump 12, and discharges the same into the high-pressure delivery pipe 16. Details of the high-pressure fuel pump 20 will be described hereinafter.

Further, the above-mentioned four injectors 4 are provided in the high-pressure delivery pipe 16 in parallel with each other. High-pressure fuel discharged from the high-pressure fuel pump 20 into the high-pressure delivery pipe 16 is supplied to each injector 4, and is injected to the corresponding cylinder 3*a* along with opening of the injector 4. Further, the high-pressure delivery pipe 16 is provided with a fuel pressure sensor 31, and a pressure of fuel (hereinafter referred to as "fuel pressure") PF in the high-pressure delivery pipe 16 is detected by the fuel pressure sensor 31, and a signal indicative of the detected fuel pressure is output to the ECU 2.

Further, the fuel supply system 1 comprises a bypass pipe 17 that bypasses the high-pressure fuel pump 20, and the bypass pipe 17 is provided with a relief valve 18. The relief valve 18 is a mechanical type, and when the fuel pressure PF in the high-pressure delivery pipe 16 reaches a predetermined relief pressure (e.g. 25 MPa), opens to allow the fuel to flow from the high-pressure delivery pipe 16 into the low-pressure delivery pipe 14 to thereby limit the fuel pressure PF within the relief pressure.

Figure 3:
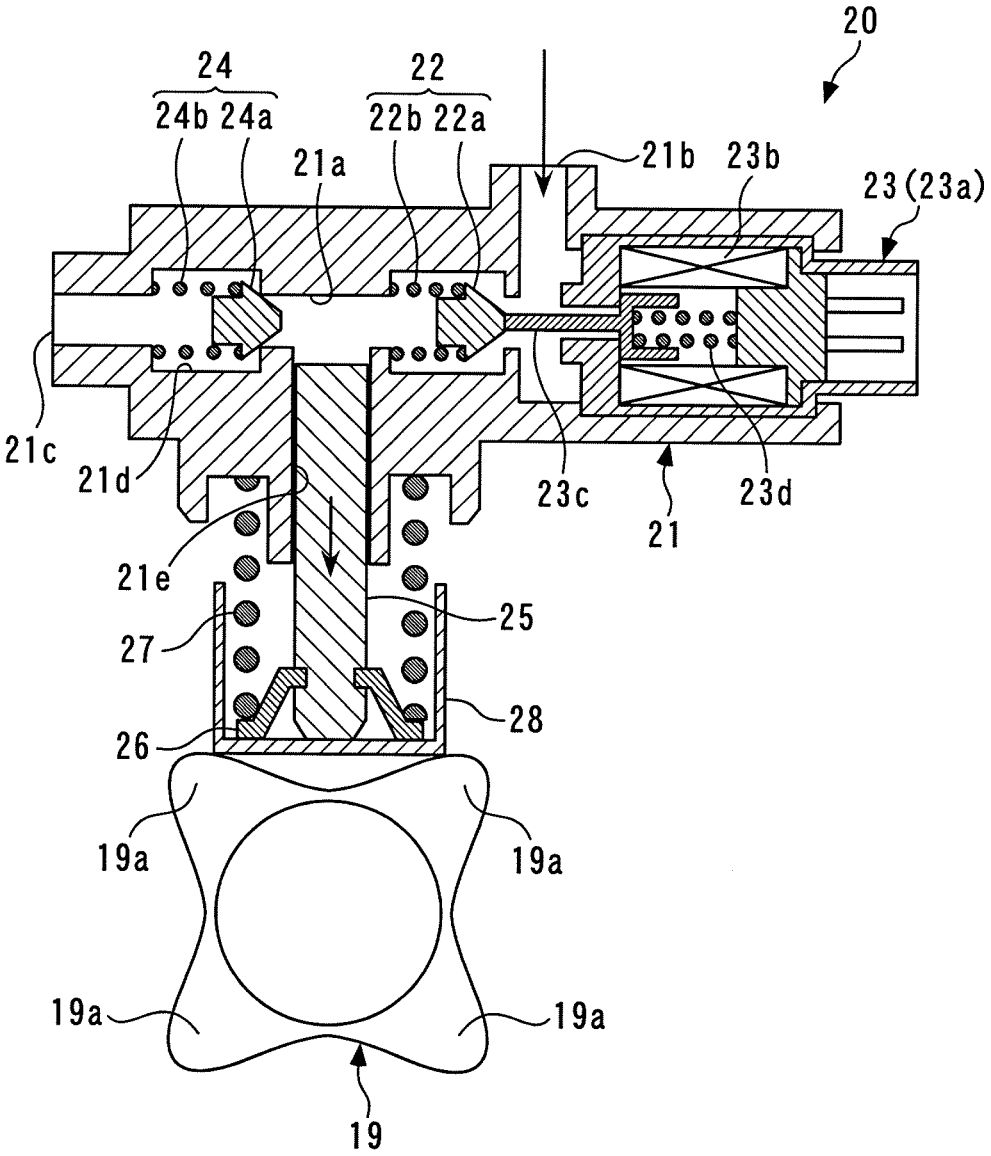
FIG. 3 is a cross-sectional view of a high-pressure fuel supply pump taken at the timing of termination of a suction stroke.
Figure 4:
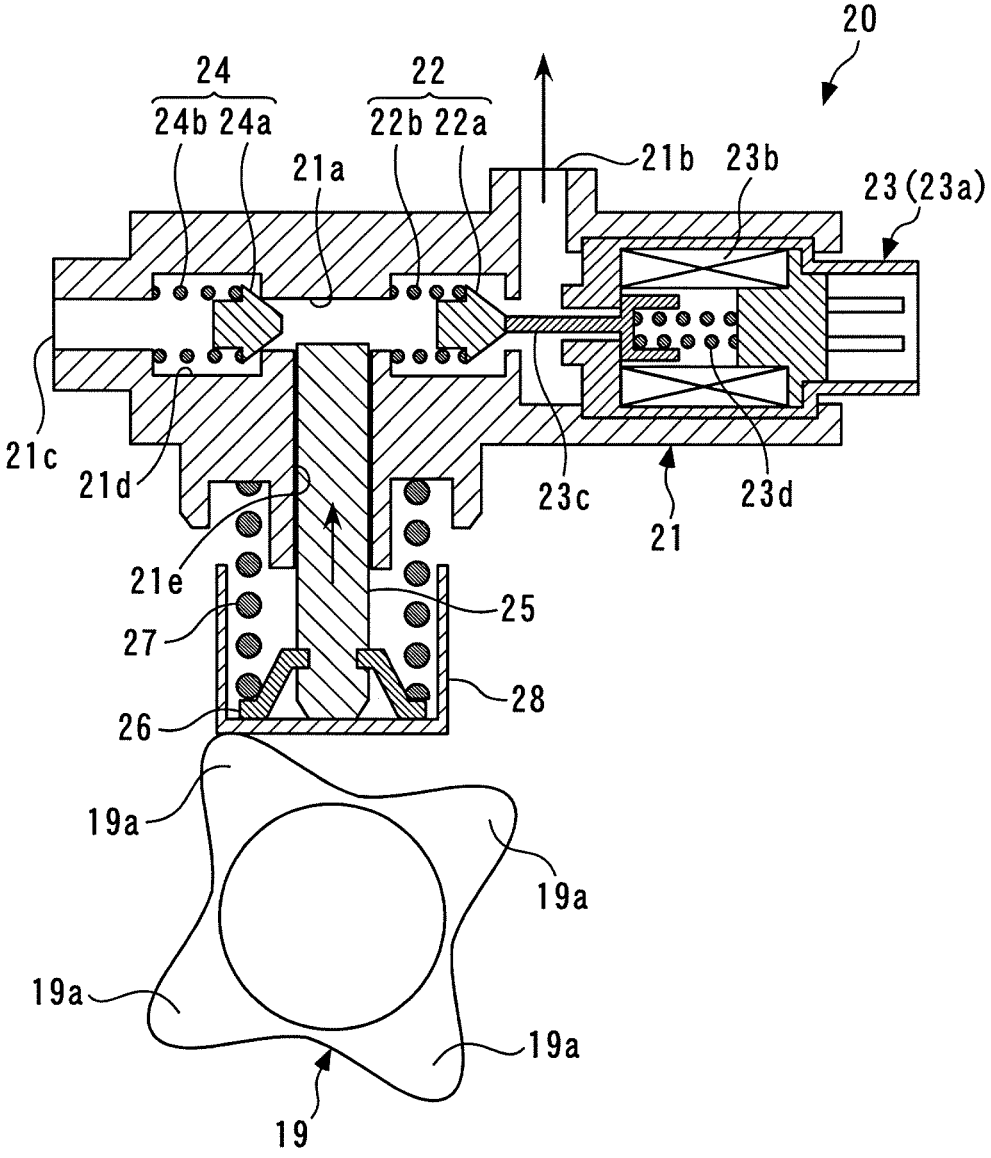
FIG. 4 is a cross-sectional view of the high-pressure fuel supply pump taken during a spill stroke.
Figure 5:
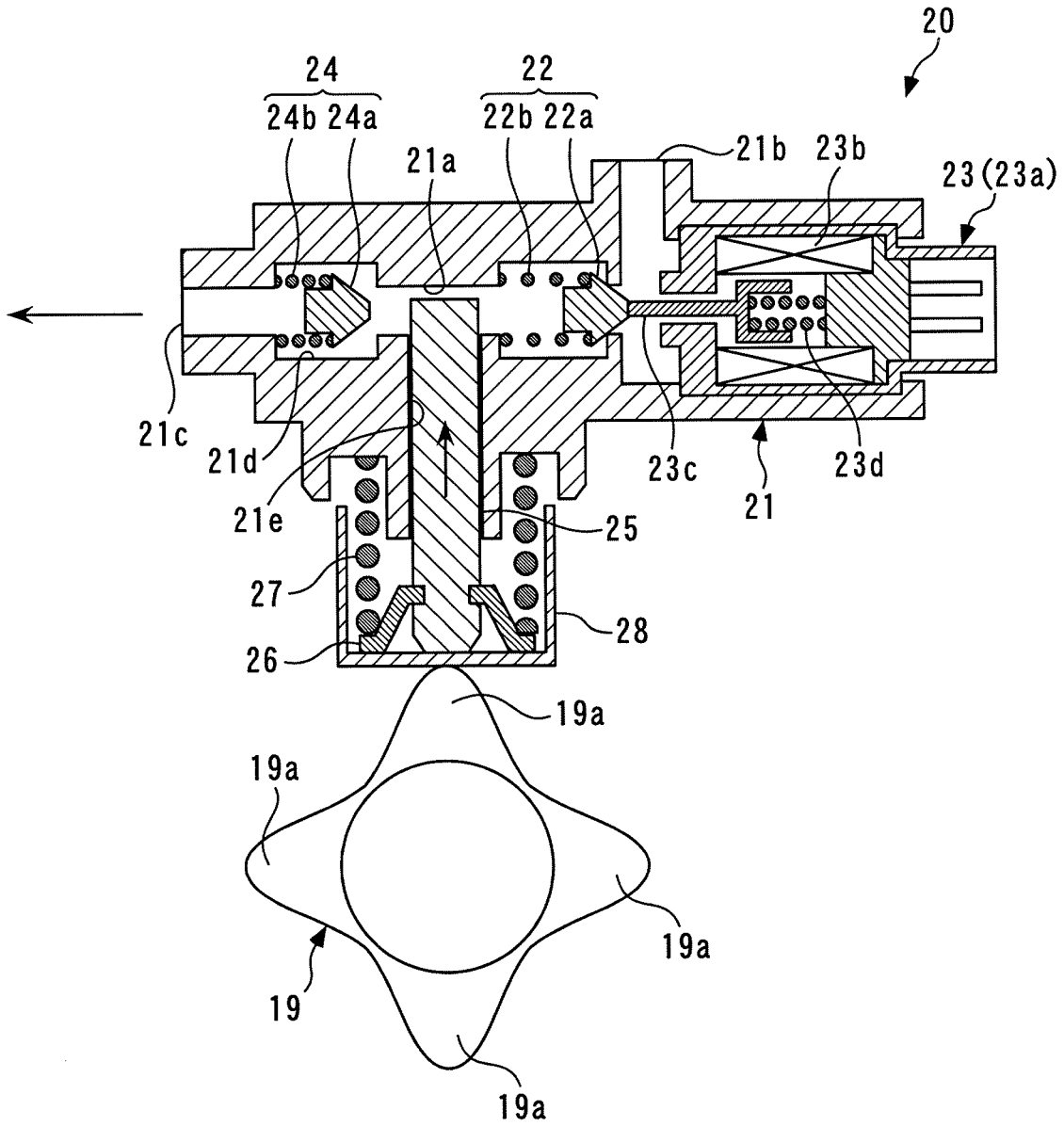
FIG. 5 is a cross-sectional view of the high-pressure fuel supply pump taken at the timing of termination of a discharge stroke.

The high-pressure fuel pump comprises, as shown in FIGS. 3 to 5, a pump main body 21, a suction check valve 22 and a discharge check valve 24, both of which are accommodated in the pump main body 21, an electromagnetic actuator 23 for driving the suction check valve 22, and a plunger 25 for being driven by a driving cam 19. The driving cam 19 includes four cam noses 19*a* which are arranged at equal space intervals in a circumferential direction, and is integrally formed on an exhaust camshaft (not shown) of the engine 3. The driving cam 19 performs one rotation per two rotations of the crankshaft.

The pump main body 21 has a pressurizing chamber 21*a* formed therein for pressurizing fuel pressure, and the pressurizing chamber 21*a* communicates with the low-pressure delivery pipe 14 via a suction opening 21*b*, and communicates with the high-pressure delivery pipe 16 via a discharge opening 21*c*. Further, the suction check valve 22, which is provided for opening and closing an inlet of the pressurizing chamber 21*a*, is accommodated in the pressurizing chamber 21*a*, and includes a valve element 22*a* and a coiled spring 22*b*. The valve element 22*a* is provided in a manner movable between an open valve position (position shown in FIG. 3) which opens the inlet of the pressurizing chamber 21*a* and a closed valve position (position shown in FIG. 5) which closes the inlet of the pressurizing chamber 21*a*, and is biased by the coiled spring 22*b* toward the closed valve position.

The electromagnetic actuator 23 cooperates with the suction check valve 22 to form a spill valve mechanism, and includes an actuator main body 23*a*, a coil 23*b*, an armature 23*c*, and an coiled spring 23*d*. The coil 23*b* is accommodated in the actuator main body 23*a*, and is electrically connected to the ECU 2. The coil 23*b* is magnetized by energization, and is held non-magnetized by stopping the energization. The energization of the coil 23*b* is controlled by the ECU 2.

Further, the armature 23*c* is accommodated in the actuator main body 23*a* in a manner movable between a predetermined home position (position shown in FIGS. 3 and 4) where the front end of the armature 23*c* is protruded toward the suction check valve 22 and a predetermined operation position (position shown in FIG. 5) where the front end of the armature 23*c* is retracted from the suction check valve 22. The armature 23*c* is held at the home position by the biasing force of the coiled spring 23*d* when the coil 23*b* is non-magnetized, and is magnetically attracted to the operation position against the biasing force of the coiled spring 23*d* when the coil 23*b* is magnetized.

Further, the biasing force of the coiled spring 23*d* of the electromagnetic actuator 23 is set to a larger value than the biasing force of the coiled spring 22*b* of the suction check valve 22, whereby when the coil 23*b* is non-magnetized, the suction check valve 22 is held open by the armature 23*c* situated at the home position (see FIG. 4).

The discharge check valve 24, which is provided for opening and closing an outlet of the pressurizing chamber 21*a*, is accommodated in a valve chamber 21*d* between the pressurizing chamber 21*a* and the discharging opening 21*c*, and includes a valve 24*a* and a coiled spring 24*b*. The valve 24*a* is provided in a manner movable between an open valve position (position shown in FIG. 5) which opens the outlet of the pressurizing chamber 21*a* and a closed valve position (position shown in FIGS. 3 and 4) which closes the outlet of the pressurizing chamber 21*a*, and is biased to the closed valve position by the coiled spring 24*b*.

Further, the plunger 25 is accommodated in a plunger barrel 21*e* of the pump main body 21 in a manner slidable between a predetermined protruded position (position shown in FIG. 5) where one end of the plunger 25 is protruded into the pressurizing chamber 21*a* and a predetermined retracted position (position shown in FIG. 3) where one end of the plunger 25 is retracted from the pressurizing chamber 21*a*. A spring seat 26 is fixed to the other end of the plunger 25, and the plunger 25 and the spring seat 26 abut the driving cam 19 via a spring holder 28.

Further, a coiled spring 27 is provided between the spring seat 26 and the pump main body 21, and the plunger 25 is biased toward the retracted position by the coiled spring 27. With the above arrangement, during rotation of the driving cam 19, the plunger 25 is held abutting the cam surface of the driving cam 19 by the biasing force of the coiled spring 27 via the spring holder 28, whereby the plunger 25 is always driven between the protruded position and the retracted position by the driving cam 19 during operation of the engine 3.

Next, a detailed description will be given of operation of the high-pressure fuel pump 20 having the above-described arrangement. Along with rotation of the driving cam 19, the high-pressure fuel pump 20 sequentially performs a suction stroke, a spill stroke, and a discharge stroke, once per one operation cycle.

First, in the suction stroke, as the driving cam 19 rotates clockwise, as viewed in FIGS. 3 to 5, from a rotational angle position shown in FIG. 5 to a rotational angle position shown in FIG. 3, the plunger 25 is moved from the protruded position to the retracted position, and fuel pressure in the pressurizing chamber 21*a* becomes lower, whereby the suction check valve 22 is opened, and fuel from the low-pressure fuel pump 12 is suctioned into the pressurizing chamber 21*a*.

In the spill stroke following the suction stroke, as the driving cam 19 rotates from the rotational angle position shown in FIG. 3 to a rotational angle position shown in FIG. 4, the plunger 25 is moved from the retracted position to the protruded position. During this time, the electromagnetic actuator 23 is controlled to be off by stopping the energization of the coil 23*b*, whereby the suction check valve 22 is held open, which causes the low-pressure fuel in the pressurizing chamber 21*a* to be returned toward the low-pressure fuel pump 12.

In the discharge stroke following the spill stroke, the driving cam 19 rotates from the rotational angle position shown in FIG. 4 to the rotational angle position shown in FIG. 5, and the electromagnetic actuator 25 is controlled to be on by the energization of the coil 23*b*, whereby the suction check valve 22 is closed. This increases the fuel pressure in the pressurizing chamber 21*a*, whereby the discharge check valve 24 is opened to discharge the high-pressure fuel in the pressurizing chamber 21*a* into the high-pressure delivery pipe 16. During the discharge stroke, the coil 23*b* is energized from an energization start timing HPSTA to an energization end timing HPEND, referred to hereinafter, whereby the electromagnetic actuator 23 is controlled to be on.

As described above, in this high-pressure fuel pump 20, during the spill stroke, the energization start timing HPSTA of the electromagnetic actuator 23 is controlled, whereby the amount of fuel returned from the pressurizing chamber 21*a* to the low-pressure fuel pump 12 is changed. This adjusts the amount of fuel discharged from the high-pressure fuel pump 20 into the high-pressure delivery pipe 16, whereby the fuel pressure PF in the high-pressure delivery pipe 16 is controlled.

Further, the crankshaft of the engine 3*a* is provided with a crank angle sensor 32 composed of a magnet rotor and an MRE pickup (both not shown) (see FIG. 2). The crank angle sensor 32 outputs a CRK signal and a TDC signal, both of which are pulse signals, along with rotation of the crankshaft.

The CRK signal is generated and output whenever the crankshaft rotates through a predetermined crank angle of 30°. The ECU 2 calculates the rotational speed of the engine 3 (hereinafter referred to as "the engine speed") NE based on the CRK signal. Further, the TDC signal indicates that a piston (not shown) in one of the cylinders is in a predetermined crank angle position (hereinafter referred to as the "reference crank angle position") in the vicinity of the TDC (top dead center) position of the intake stroke of the piston. In the present embodiment, since the engine 3 has the four cylinders 3*a*, and hence the TDC signal is generated and output whenever the crankshaft rotates through a crank angle of 180°. Further, the engine 3 is provided with a cylinder discrimination sensor (not shown), and the cylinder discrimination sensor delivers a cylinder discrimination signal, which is a pulse signal for use in discriminating each cylinder 3*a*, to the ECU 2.

Further, an accelerator pedal opening sensor 33 delivers a detection signal indicative of a stepped-on amount AP of an accelerator pedal, not shown, (hereinafter referred to as the "accelerator pedal opening") to the ECU 2.

Figure 6:
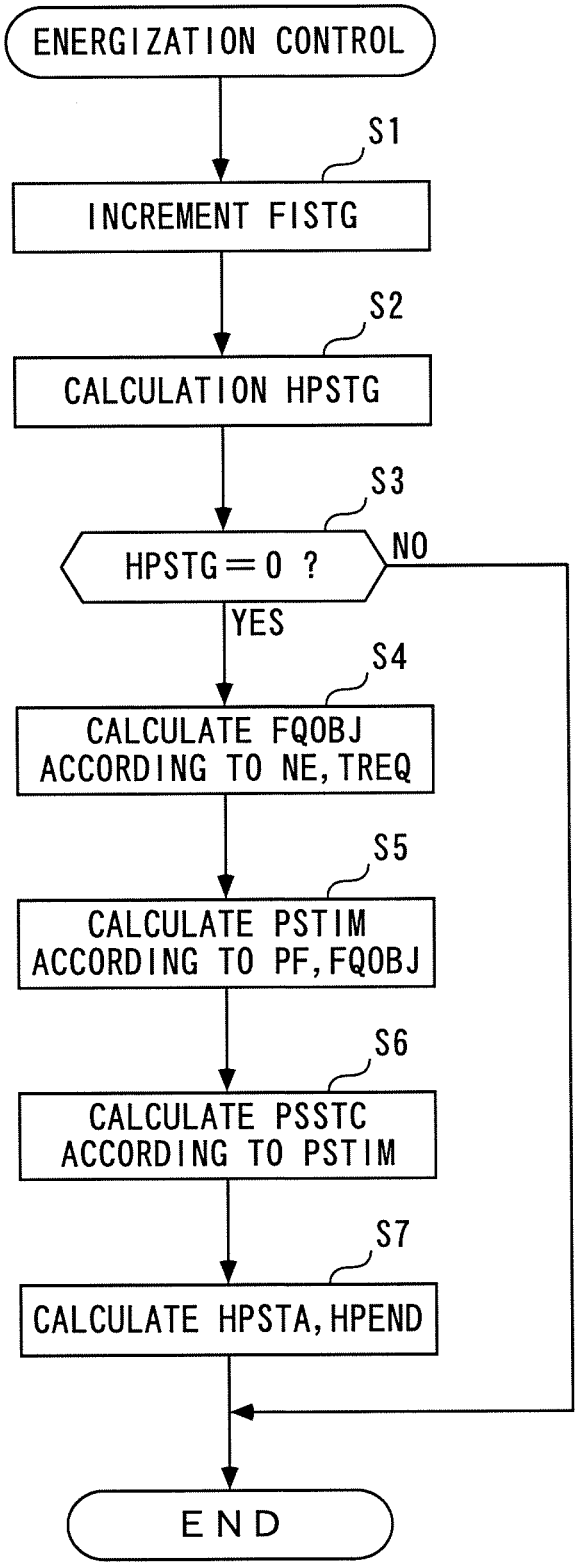
FIG. 6 is a flowchart of an energization control process executed by the ECU.

The ECU 2 is implemented by a microcomputer comprising a CPU, a RAM, a ROM, and an I/O interface (none of which are specifically shown). The ECU 2 executes an energization control process shown in FIG. 6 based on the detection signals from the above-mentioned various sensors 31 to 33, according to a control program stored in the ROM, so as to control on and off of the electromagnetic actuator 23 with a view to controlling the amount of fuel discharged from the high-pressure fuel pump 20 toward the injector 4.

This energization control process is repeatedly executed during operation of the engine 3, in synchronism with the generation of the above-mentioned CRK signal. First, in a step 1 in FIG. 6 (shown as S1 in abbreviated; the following steps are also shown in abbreviated form) a crank angle stage FISTG is incremented. The crank angle stage FISTG is one of stage numbers 0 to 23 sequentially allocated to respective 24 crank angle sections which are obtained by dividing a crank angle cycle of 720° set with reference to the above-mentioned reference crank angle position (=0°) of e.g. #1 cylinder 3*a* by a predetermined crank angle (30°) which is a generation interval of the CRK signal (see FIG. 7). When the engine 3 is started, the crank angle stage FISTG is set, based on the above-mentioned cylinder discrimination signal, the TDC signal, and the CRK signal, to a stage number corresponding to the crank angle position at the time. Thereafter, the crank angle stage FISTG is incremented by executing the step 1 whenever the CRK signal is generated, that is, whenever the crankshaft rotates through 30°.

In a step 2 following the above-mentioned step 1, a pump control stage HPSTG is calculated. The pump control stage HPSTG represents one of angle sections of the driving cam 19 which rotates through ½ of an angle (crank angle) of rotation of the crankshaft. Specifically, the pump control stage FPSTG is indicated by one of stage numbers 0 to 5 sequentially allocated to respective six crank angle sections which are obtained by dividing a crank angle cycle of 180° by the predetermined crank angle (30°) (see FIG. 7. Calculation timings, such as the energization start timing HPSTA and the energization end timing HPEND, mentioned hereinabove, of the electromagnetic actuator 23 are defined by stage number 0.

The reason for defining the pump control stages HPSTG in a crank angle cycle of 180° is as follows: Because of the construction of the above-mentioned driving cam 1*a*, the sequence of the suction stroke, the spill stroke, and the discharge stroke of the high-pressure fuel pump 20 is executed whenever the crank angle rotates through a crank angle of 180°. Specifically, the pump control stage HPSTG is calculated in the following manner:

A value obtained by adding a predetermined offset stage to the crank angle stage FISTG incremented in the step 1 is divided by a predetermined pump control stage number ((FISTG+offset stage)/pump control stage number), and the remainder is calculated as the pump control stage HPSTG.

The offset stage is a value indicating how many stages a generation timing of the TDC signal (hereinafter referred to as "TDC occurrence timing") TTDC is delayed with reference to a timing (hereinafter referred to as "cam nose top timing") TTOP at which a top of the cam nose 19*a* of the above-mentioned driving cam 19 is abutting the plunger 25. The offset stage is determined before shipping the vehicle from a plant and is stored in the ROM of the ECU 2. In this case, when a crank angle-equivalent value (hereinafter referred to as "timing deviation angle") indicative of a deviation of the TDC occurrence timing TTDC from the cam nose top timing TTOP is not a multiple of the crank angle (30°) corresponding to one stage, the offset stage is set to a value which is obtained by adding 1 to a quotient of division of the timing deviation angle by 30°. Further, when the TDC occurrence timing TTDC coincides with the cam nose top timing TTOP (hereinafter referred to as "timing matching time"), the offset stage is set to 0. The above-mentioned pump control stage number represents the number of stages for one cycle of the pump control stage HPSTG, and in the present embodiment, it is 180/30=6.

Figure 7:
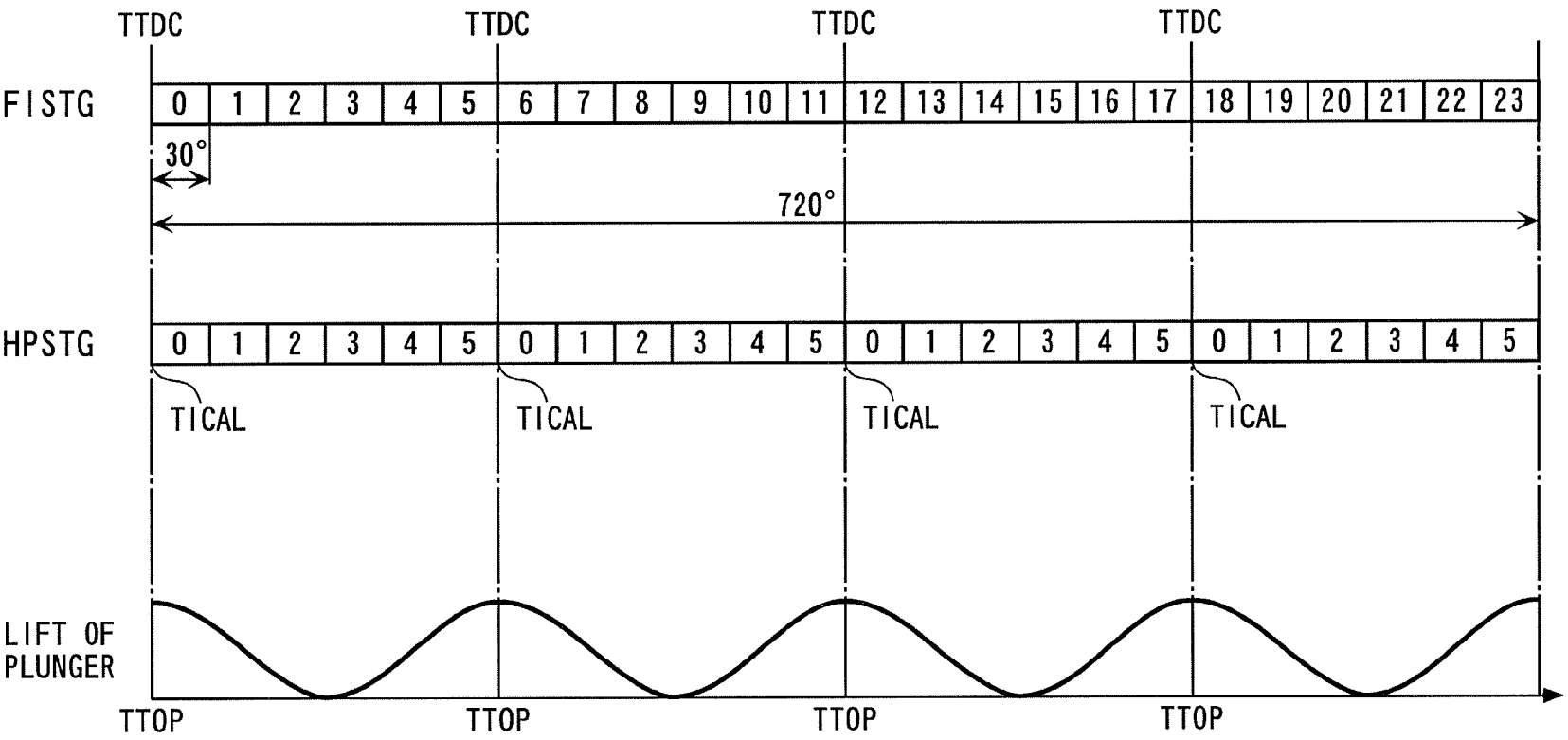
FIG. 7 is a diagram showing an example of operation of the fuel supply system.

From the above, the pump control stage HPSTG is calculated as follows: As shown in FIG. 7, at the timing matching time (when the TDC occurrence timing TTDC coincides with the cam nose top timing), the pump control stage HPSTG is calculated based on the crank angle stage FISTG. For example, when the crank angle stage FISTG is a multiple of 6 (6n) in a processing cycle of the present time, i.e. when the crank angle stage FISTG corresponds to the TDC occurrence timing TTDC, the pump control stage HPSTG is calculated as 0 which is the remainder of (FISTG+offset stage)/pump control stage number=(6n+0)/6 (see FIG. 7). As a result, the timing that the pump control stage HPSTG becomes 0 coincides with TDC occurrence timing TTDC and the cam nose top timing TTOP.

Figure 8:
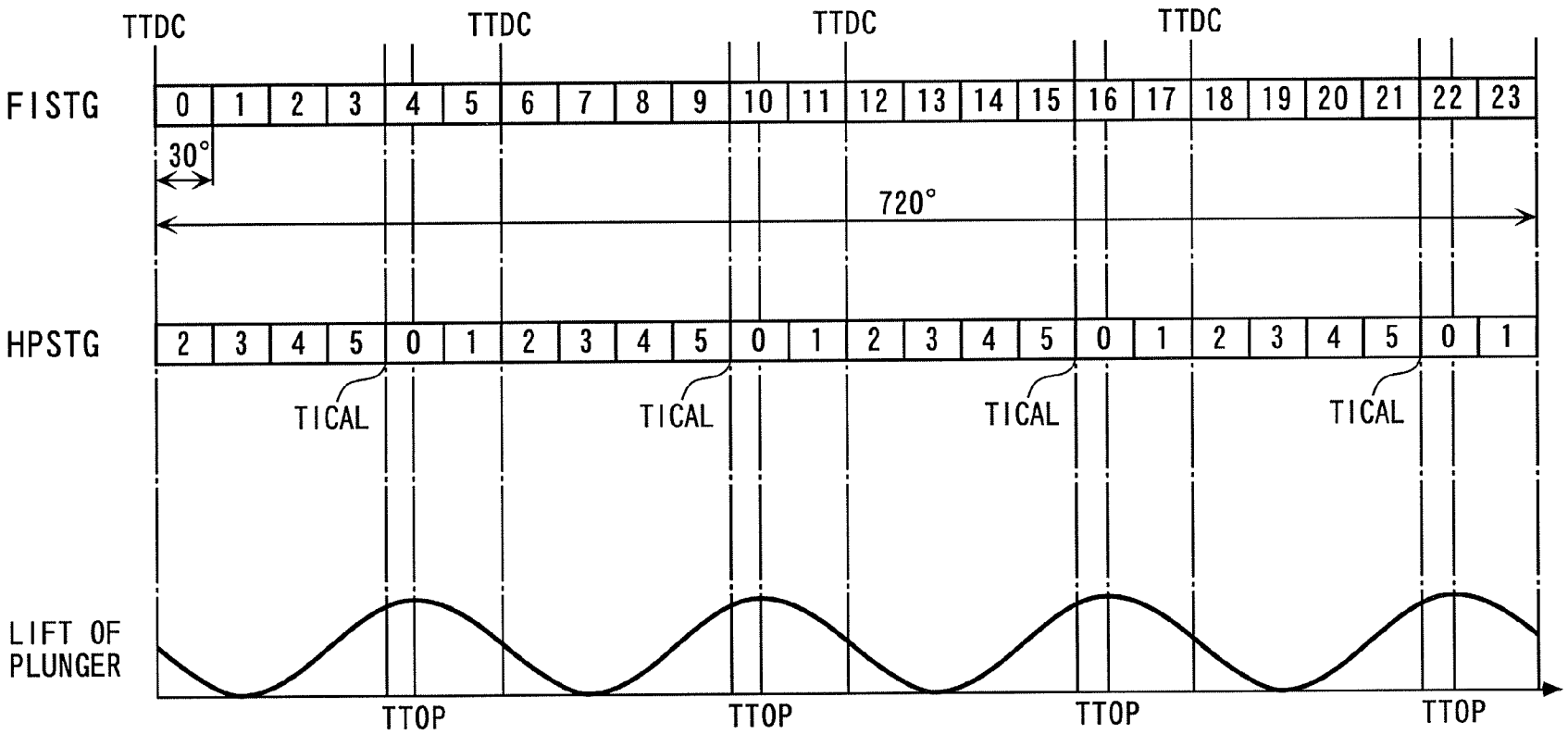
FIG. 8 is a diagram showing an example of operation other than the example shown in FIG. 7.

On the other hand, as shown in FIG. 8, when the TDC occurrence timing TTDC deviates from the cam nose top timing TTOP (hereinafter referred to as "timing non-matching time"), the pump control stage HPSTG is calculated according to the offset stage indicating a deviation by a stage number and the crank angle stage FISTG. For example, when the offset stage is 2 and at the same time the crank angle stage FISTG is 6n−2 in the present processing cycle, the pump control stage HPSTG is calculated as 0 which is the reminder of (FISTG+offset stage)/pump control stage number={(6n−2)+2}/6 (see FIG. 8).

Further, as described above, at the timing non-matching time, when the timing deviation angle (crank angle-equivalent value of a deviation of TTDC from TTOP) is not a multiple of the crank angle of one stage, the offset stage is set to a quotient of division of the former by the latter+1. As a result, the timing at which the pump control stage HPSTG becomes 0 is a timing advanced with respect to the cam nose top timing TTOP and closest to the TTOP (see FIG. 8). Further, when the timing deviation angle is a multiple of the crank angle of one stage, the timing at which the pump control stage HPSTG becomes 0 coincides with the cam nose top timing TTOP.

In a step 3 following the above-described step 2, it is determined whether or not the calculated pump control stage HPSTG is 0. If the answer to this question is negative (NO), the present process is immediately terminated, whereas if the same is affirmative (YES), i.e. if HPSTG=0 holds, it is judged that an energization time-calculating timing TICAL (see FIGS. 7 and 8) has come, so that a step 4 et. seq are carried out to perform the calculation. The energization time-calculating timing TICAL is a timing for calculating the energization start timing HPSTA, the energization end timing HPEND, and an energization time period PSTIM, referred to hereinafter.

First, in the step 4, a target discharge amount FQOBJ is calculated by searching a predetermined map (not shown) according to the engine speed NE and a demanded torque TREQ which are calculated. The target discharge amount FQOBJ is a target value of the amount of fuel to be discharged from the high-pressure fuel pump 20. Further, the demanded torque TREQ is a torque demanded by the engine 3, and is calculated by searching a predetermined map (not shown) according to the engine speed NE and the detected accelerator opening degree AP. Next, the energization time period PSTIM is calculated by searching a predetermined map (not shown) according to the detected fuel pressure PF in the high-pressure delivery pipe 16 and the target discharge amount FQOBJ calculated in the step 4 (step 5). The energization time period PSTIM is an energization time period over which the coil 23*b* of the electromagnetic actuator 23 is energized, and is represented by a rotational angle of the driving cam 19.

Next, an energization start angle PSSTC is calculated based on the calculated energization time period PSTIM by the following formula (1) (step 6). The energization start angle PSSTC represents the energization start timing HPSTA of the electromagnetic actuator 23 as a crank angle with reference to a timing at which the pump control stage HPSTG becomes 0, i.e. with reference to the energization time-calculating timing TICAL (0°).

$$PSSTC=(CORCA+180)-PSTIM\cdot 2 \quad (1)$$

wherein CORCA is a deviation correction value, details of which will be described hereinafter.

Figure 9:
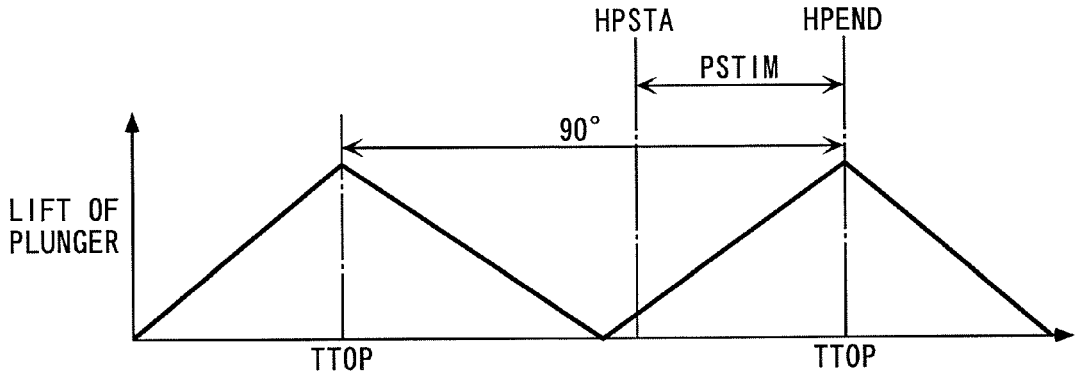
FIG. 9 is a diagram useful in explaining a method of calculating an energization start angle calculated in the energization control process shown in FIG. 6.
Figure 10:
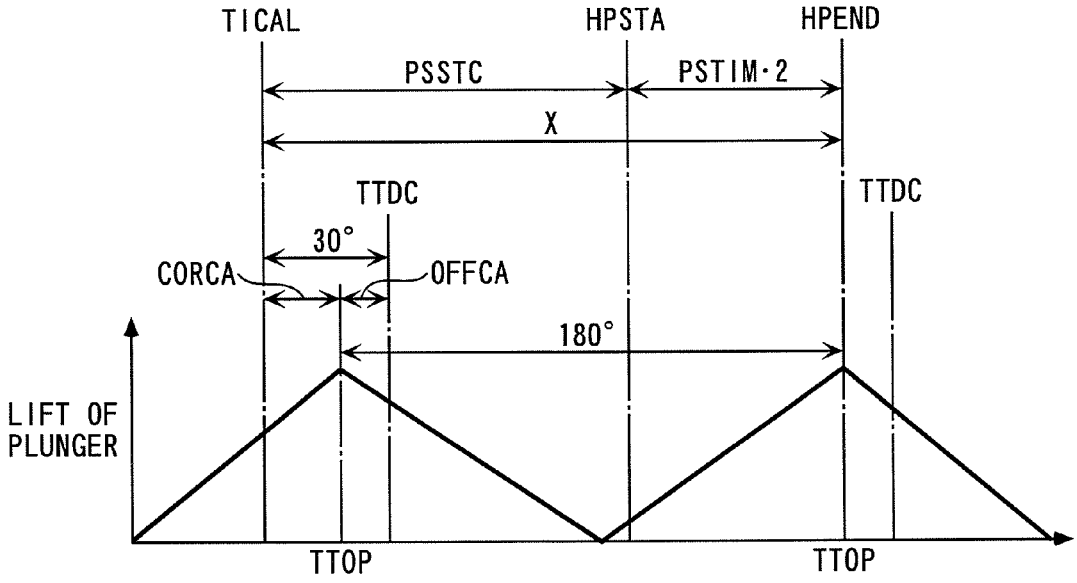
FIG. 10 is another diagram useful in explaining the method of calculating an energization start angle.

A method of calculating the energization start angle PSSTC will be described with reference to FIGS. 9 and 10. As shown in FIGS. 9 and 10, the energization end timing HPEND of the electromagnetic actuator 23 is set to the cam nose top timing TTOP. Further, as mentioned hereinabove, the energization time period PSTIM is represented by the rotational angle of the driving cam 19, and hence the energization time period PSTIM is converted to a crank angle of PSTIM·2.

Further, OFFCA appearing in FIG. 10 indicates the above-mentioned timing deviation angle (crank angle-equivalent value of a deviation of TTDC from TTOP), which is set beforehand according to the design specifications of the engine 3 and is stored in the ROM. As shown in FIG. 10, the deviation correction value CORCA used in the equation (1) indicates a time period represented by a crank angle from the energization time-calculating timing TICAL (HPSTG=0) to the cam nose top timing TTOP which is delayed, and is calculated by subtracting this timing deviation angle OFFCA from a value calculated by multiplying the above-mentioned offset stage by the predetermined crank angle (30°) (offset stage·30−OFFCA). For example, as shown in FIG. 10, when the TDC occurrence timing TTDC deviates toward the delayed side from the cam nose top timing TTOP by less than one stage and the offset stage is 1, the deviation correction value CORCA is calculated as 1·30−OFFCA.

Further, as described hereinabove, the energization end timing HPEND is set to the cam nose top timing TTOP, and the cam nose top timing TTOP occurs at a repetition period of a crank angle of 180°. From the above, as shown in the formula (1), the energization start angle PSSTC can be properly calculated by subtracting PSTIM·2 which is a crank angle converted from the energization time period PSTIM, from the sum of the above-mentioned deviation correction value CORCA and the crank angle 180° (corresponding to X in FIG. 10).

In a step 7 following the above-mentioned step 6, the energization start timing HPSTA and the energization end timing HPEND are calculated, followed by terminating the present process. Specifically, the energization start timing HPSTA is calculated by converting the calculated energization start angle PSSTC to time according to the engine speed NE. Further, the energization end timing HPEND is calculated by converting the sum of the deviation correction value CORCA and the crank angle 180 (corresponding to X in FIG. 10)° to time according to the engine speed NE. From the above, the energization start timing HPSTA and the energization end timing HPEND are defined as time periods to elapse from the energization time-calculating timing TICAL.

Further, after the energization start timing HPSTA and the energization end timing HPEND are calculated by the execution of the step 7, the coil 23*b* is energized, as described hereinabove, from the energization start timing HPSTA to the energization end timing HPEND, whereby the electromagnetic actuator 23 is controlled to be on.

Further, correspondence between elements of the present embodiment and elements of the present invention is as follows: the ECU 2 of the present embodiment corresponds to energization time-calculating means, correction means, and calculation timing-setting means of the present invention, and the high-pressure fuel pump 20 of the present embodiment corresponds to a fuel pump. Further, the suction check valve 22 and the electromagnetic actuator 23 of the present embodiment correspond to an electromagnetic valve of the present invention.

As described above, according to the present embodiment, the pump control stage HPSTG is calculated, which is one of the six sections obtained by dividing the crank angle cycle of 180° defined with reference to the reference crank angle position by the predetermined crank angle. Further, the timing at which the pump control stage HPSTG becomes 0 is set as the energization time-calculating timing TICAL for calculating the energization time period PSTIM and so forth. (step 1 to 3).

At the timing matching time, the pump control stage HPSTG becomes 0 at the same timing with the TDC occurrence timing TTDC and the cam nose top timing TTOP, and the timing is set as the energization time-calculating timing TICAL (see FIG. 7). On the other hand, at the timing non-matching time, the pump control stage HPSTG becomes 0 at a timing which is advanced from and closest to the cam nose top timing TTOP. As a result, the energization time-calculating timing TICAL is corrected such that it becomes closer to the cam nose top timing TTOP from the TDC occurrence timing TTDC, and is set to a timing advanced from the cam nose top timing TTOP (see FIG. 8).

This makes it possible to calculate the energization time period PSTIM etc. according to newer operating conditions (the fuel pressure PF of the high-pressure delivery pipe 16, the engine speed NE, the demanded torque TREQ) of the engine 3, and calculate the energization time period PSTIM etc. at such an appropriate timing that the energization of the electromagnetic actuator 23 is positively completed within the calculated energization time period PSTIM. Therefore, it is possible to properly calculate the energization time period PSTIM etc. according to the newer operating conditions of the engine 3, and positively complete the energization of the electromagnetic actuator 23 within the energization time period PSTIM, and in turn, it is possible to control the amount of fuel discharged from the high-pressure fuel pump 20 toward the injector 4.

Further, the crank angle stage FISTG for use in setting the pump control stage HPSTG is generally used for control of fuel injection etc. of the engine 3, and hence correction (setting) of the energization time-calculating timing TICAL can be properly executed using the crank angle stage FISTG.

Further, at the timing non-matching time, when the timing deviation angle OFFCA is a multiple of the crank angle of one stage, the timing at which the pump control stage HPSTG becomes 0, i.e. the energization time-calculating timing TICAL coincides with the cam nose top timing TTOP. Therefore, it is possible to more effectively obtain the advantageous effects described above.

Note that the present invention is by no means limited to the embodiment described above, but can be practiced in various forms. For example, although in the above-described embodiment, the reference crank angle position, i.e. the predetermined crank angle position close to the TDC at the start time of the intake stroke is used as the predetermined crank angle position in the present invention, since the fuel injection timing of the injector 4 is controlled to the predetermined timing within the time period from the intake stroke to the compression stroke, any other suitable crank angle position, e.g. a crank angle position corresponding to the TDC at the start time of the intake stroke, may be used. Alternatively, in a case where the fuel injection timing of the injector is controlled to a predetermined timing during the compression stroke, a crank angle position corresponding to a BDC (bottom dead center) at the start time of the compression stroke, or a crank angle position within a predetermined crank angle section including the crank angle position corresponding to the BDC, and preceding and following the same.

Further, although in the embodiment, the predetermined cam angle timing in the present invention is set to the cam nose top timing TTOP, but it may be set to a timing corresponding to a predetermined rotational angle position of the driving cam, within a predetermined time period including the cam nose top timing, and preceding and following the same. Further, although in the embodiment, the predetermined crank angle in the present invention is set to 30°, only by a way of example, this is not limitative, but by setting the same to another suitable angle, e.g. a smaller angle, the energization time-calculating timing can be made closer to the cam nose top timing.

Further, although in the embodiment, the pump control stage HPSTG converted from the crank angle stage FISTG is used for setting the energization time-calculating timing TICAL, FISTG may be directly used without using HPSTG. In this case, at the timing matching time, from a plurality of crank angle stages, one corresponding to the same timing as the TDC occurrence timing and the cam nose top timing is selected for setting the energization time-calculating timing. On the other hand, at the timing non-matching time, when the timing deviation angle is not a multiple of the predetermined crank angle, from a plurality of crank angle stages, one corresponding to the closest timing to the cam nose top timing is selected for setting the energization time-calculating timing. In this case, any crank angle stage which is either advanced or delayed from the cam nose top timing may be used. Further, at the timing non-matching time, when the timing deviation angle is a multiple of the predetermined crank angle, from a plurality of crank angle stages, one corresponding to the same timing as the cam nose top timing is selected for setting the energization time-calculating timing.

Further, in the embodiment, although the known offset stage and the timing deviation angle OFFCA which represent a deviation of the TDC occurrence timing TTDC from the cam nose top timing TTOP are stored beforehand in the ROM of the ECU 2, this is not limitative, but a sensor may be provided for detecting the rotational angle position of the driving cam and the rotational angle position of the driving cam may be detected on an as-needed basis, using this sensor. For example, in a case where a cam phase, which is a phase of the camshaft provided with the driving cam, with respect to the crankshaft, is changed by a cam phase variable mechanism, the deviation of the TDC occurrence timing from the cam nose top timing varies with this change of the cam phase. Therefore, particularly in this case, by detecting this deviation as described above and using the detected deviation for setting the energization time-calculating timing, it is possible to effectively obtain the advantageous effect that the calculation is executed at the proper timing.

Further, the high-pressure fuel pump 20 in the embodiment is a type of a pump in which, by closing the suction check valve 22 of a normally open type during the spill stroke, the amount of fuel returned to the low-pressure fuel pump 4 from the pressurizing chamber 21*a* is adjusted, whereby the amount of fuel to be discharged toward the injector 4 is adjusted. The present invention is by no means limited to this, but can be applied to any fuel pump that is driven by the driving cam which uses the engine as the motive power source.

For example, in the embodiment, although the suction check valve 22 and the electromagnetic actuator 23 are configured such that the energization of the coil 23*b* continues during the discharge stroke, they may be configured such that the energization of the coil of the electromagnetic actuator is executed only at an early stage of the compression stroke. In this case, the suction check valve and the electromagnetic actuator are constructed, more specifically, as follows. The suction check valve is constructed as a normally open type by omitting the coiled spring that biases the suction check valve toward the closed valve position, but providing only the coiled spring that biases the suction check valve toward the open valve position via the armature. Further, the biasing force of the coiled spring is set to be as large as that of the coiled spring of the discharge check valve of a normally closed type. Further, the suction check valve is constructed such that the suction check valve is pushed toward the closed valve position by the fuel pressure in the pressurizing chamber. The other construction is same as in the embodiment.

In this case, the suction check valve and the electromagnetic actuator operate as follows: During the spill stroke, the armature of the electromagnetic actuator is moved against the biasing force of the coiled spring that biases the suction check valve, by magnetization of the coil caused by energization thereof, whereby the suction check valve is released from the bias toward the open valve position by the coiled spring. Because of this and because of an increase in the fuel pressure in the pressurizing chamber caused by the movement of the plunger to the protruded position, the suction check valve is closed, whereby the high-pressure fuel pump shifts to the discharge stroke. Then, during the discharge stroke, after the discharge check valve is opened by a further increase in the fuel pressure in the pressurizing chamber, the coil is controlled to be non-magnetized. In this case, the fuel pressure in the pressurizing chamber which pushes the suction check valve toward the closed valve position is larger than the biasing force of the coiled spring that biases the suction check valve toward the open valve position, the discharge check valve is held in the closed state during the discharge stroke.

Further, although in the embodiment, the driving cam 19 is provided on the exhaust camshaft, this is not limitative, but the driving cam in the present invention is only required to be driven by the engine used as the motive power source, and for example, the driving cam may be provided on an intake camshaft that drives intake valves of the engine. Alternatively, the driving cam be provided on a shaft connected via gears to the crankshaft of the engine. Further, although in the embodiment, the number of the cylinders 3*a* is four, the number may be any desired number. Further, although the embodiment is an example of application of the present invention to the gasoline engine for a vehicle, the present invention is not limited to this but it can be applied to e.g. a diesel engine, and even to engines for ship propulsion machines, such as an outboard motor having a vertically-disposed crankshaft. Further, it can be applied to a V engine with six cylinders.

It is further understood by those skilled in the art that the foregoing are preferred embodiments of the invention, and that various changes and modifications may be made without departing from the spirit and scope thereof.

What is claimed is:

1. A fuel supply system for an internal combustion engine, comprising:

a fuel pump including a plunger abutting a driving cam which uses the engine as a motive power source, said fuel pump discharging fuel toward a fuel injection valve by having said plunger driven by the driving cam;

an electromagnetic valve for adjusting an amount of fuel to be discharged from said fuel pump toward the fuel injection valve;

energization time-calculating means for calculating an energization time of said electromagnetic valve for obtaining the amount of fuel to be discharged according to operating conditions of said internal combustion engine, said energization time-calculating means using a predetermined timing which corresponds to a predetermined crank angle position of the engine, as a calculation timing which is a timing to perform a calculation of the energization time; and correction means for correcting, when the predetermined timing deviates from a predetermined cam angle timing which is within a predetermined time period including a timing at which a top of a cam nose of the driving cam is abutting said plunger, and preceding and following the timing, and corresponds to a predetermined rotational angle position of the driving cam, the calculation timing such that the calculation timing is made closer to the cam angle timing.

2. The fuel supply system as claimed in claim 1, wherein a plurality of crank angle positions including the predetermined crank angle position are set every predetermined crank angle, and wherein said correction means corrects the calculation timing by selecting from a plurality of timings which correspond to the plurality of crank angle positions, respectively, one which is advanced from the cam angle timing and closest to the cam angle timing, as the calculation timing.

3. The fuel supply system as claimed in claim 1, wherein the fuel supply system is provided in a vehicle, the fuel supply system further comprising storage means storing an offset parameter which represents a deviation of the predetermined timing from the cam angle timing, which is determined before a shipping time of the vehicle, and wherein said correction means corrects the calculation timing based on the stored offset parameter.

4. The fuel supply system as claimed in claim 2, wherein the fuel supply system is provided in a vehicle, the fuel supply system further comprising storage means storing an offset parameter which represents a deviation of the predetermined timing from the cam angle timing, which is determined before a shipping time of the vehicle, and wherein said correction means corrects the calculation timing based on the stored offset parameter.

5. The fuel supply system as claimed in claim 1, wherein the driving cam is integrally provided on a camshaft interlocked with a crankshaft of the engine, and wherein a cam phase variable mechanism is provided which changes a cam phase which is a phase of the camshaft with respect to the crankshaft, the fuel supply system further comprising offset parameter-detecting means for detecting an offset parameter which represents a deviation of the predetermined timing from the cam angle timing, and wherein said correction means corrects the calculation timing based on the detected offset parameter.

6. The fuel supply system as claimed in claim 2, wherein the driving cam is integrally provided on a camshaft interlocked with a crankshaft of the engine, and wherein a cam phase variable mechanism is provided which changes a cam phase which is a phase of the camshaft with respect to the crankshaft, the fuel supply system further comprising offset parameter-detecting means for detecting an offset parameter which represents a deviation of the predetermined timing from the cam angle timing, and wherein said correction means corrects the calculation timing based on the detected offset parameter.

7. A fuel supply system for an internal combustion engine, comprising:

a fuel pump including a plunger abutting a driving cam which uses the engine as a motive power source, said fuel pump discharging fuel toward a fuel injection valve by having said plunger driven by the driving cam;

an electromagnetic valve for adjusting an amount of fuel to be discharged from said fuel pump toward the fuel injection valve;

energization time-calculating means for calculating an energization time of said electromagnetic valve for obtaining the amount of fuel to be discharged according to operating conditions of said internal combustion engine; and calculation timing-setting means for setting, when a predetermined timing corresponding to a predetermined crank angle position of the engine deviates from a predetermined cam angle timing which is within a predetermined time period including a timing at which a top of a cam nose of the driving cam is abutting said plunger, and preceding and following the timing, and corresponds to a predetermined rotational angle position of the driving cam, out of a plurality of timings which correspond respectively to a plurality of crank angle positions set every predetermined crank angle such that the predetermined crank angle position is included, one closest to the cam angle timing, as a calculation timing which is a timing to perform a calculation of the energization time by said energization time-calculating means.

8. The fuel supply system as claimed in claim 7, wherein the fuel supply system is provided in a vehicle, the fuel supply system further comprising storage means storing an offset parameter which represents a deviation of the predetermined timing from the cam angle timing, which is determined before a shipping time of the vehicle, and wherein said calculation timing-setting means sets the calculation timing based on the stored offset parameter.

9. The fuel supply system as claimed in claim 7, wherein the driving cam is integrally provided on a camshaft interlocked with a crankshaft of the engine, and wherein a cam phase variable mechanism is provided which changes a cam phase which is a phase of the camshaft with respect to the crankshaft, the fuel supply system further comprising offset parameter-detecting means for detecting an offset parameter which represents a deviation of the predetermined timing from the cam angle timing, and wherein said calculation timing-setting means sets the calculation timing based on the detected offset parameter.

* * * * *